US008701785B2

(12) United States Patent
Nikiforuk

(10) Patent No.: US 8,701,785 B2
(45) Date of Patent: Apr. 22, 2014

(54) SHRINKABLE SLEEVE STABILIZER

(75) Inventor: Kevin James Nikiforuk, Houston, TX (US)

(73) Assignee: Tesco Corporation, Houston, TX (US)

( * ) Notice: Subject to any disclaimer, the term of this patent is extended or adjusted under 35 U.S.C. 154(b) by 641 days.

(21) Appl. No.: 13/005,357

(22) Filed: Jan. 12, 2011

(65) Prior Publication Data

US 2012/0175129 A1 Jul. 12, 2012

(51) Int. Cl.
*E21B 17/10* (2006.01)

(52) U.S. Cl.
USPC ..... 166/378; 166/241.6; 175/325.6

(58) Field of Classification Search
USPC ..... 166/378, 380, 241.6; 175/325.5
See application file for complete search history.

(56) References Cited

U.S. PATENT DOCUMENTS

| | | | | |
|---|---|---|---|---|
| 3,131,104 | A * | 4/1964 | Korn | 156/73.6 |
| 3,351,136 | A * | 11/1967 | Nelson | 166/173 |
| 3,360,846 | A | 1/1968 | Schellstede | |
| 3,916,999 | A * | 11/1975 | Ellis et al. | 166/206 |
| 4,011,918 | A * | 3/1977 | Jurgens | 175/325.2 |
| 4,088,185 | A | 5/1978 | Carson | |
| 4,662,461 | A * | 5/1987 | Garrett | 175/325.4 |
| 5,277,254 | A | 1/1994 | Rullman | |
| 5,470,622 | A * | 11/1995 | Rinde et al. | 428/34.9 |
| 6,513,223 | B1 | 2/2003 | Angman | |
| 6,585,052 | B2 * | 7/2003 | Angman et al. | 166/380 |
| 6,679,335 | B2 | 1/2004 | Slack | |
| 7,082,997 | B2 | 8/2006 | Slack | |
| 7,124,825 | B2 | 10/2006 | Slack | |
| 7,409,758 | B2 | 8/2008 | Le | |
| 8,225,864 | B2 * | 7/2012 | Angman | 166/241.6 |
| 2003/0024707 | A1 * | 2/2003 | Angman et al. | 166/380 |
| 2008/0164019 | A1 * | 7/2008 | Angman | 166/241.6 |
| 2009/0200013 | A1 * | 8/2009 | Craster et al. | 166/242.4 |
| 2009/0236091 | A1 * | 9/2009 | Hammami et al. | 166/242.1 |
| 2010/0212969 | A1 | 8/2010 | Radford | |
| 2010/0326671 | A1 * | 12/2010 | Buytaert et al. | 166/378 |
| 2011/0217493 | A1 * | 9/2011 | Cowen | 428/34.9 |
| 2012/0175129 | A1 * | 7/2012 | Nikiforuk | 166/380 |

OTHER PUBLICATIONS

Brochure, Canusa-CPS, A Shawcor Company for "TBK XL-65 Directional Drilling Kit," date unknown.

* cited by examiner

*Primary Examiner* — Jennifer H Gay
(74) *Attorney, Agent, or Firm* — Bracewell & Giuliani LLP

(57) ABSTRACT

Shrinkable sleeve stabilizers formed around the outer surface of a pipe to enhance position stability of the pipe when operably positioned within a well bore and related methods, are provided. The shrinkable sleeve stabilizer according to an embodiment of the invention includes a plurality of elongate stabilizer blades shaped and configured to connect around an outer diameter of the pipe, and a shrinkable sleeve sized to wrap around an outer surface of the each of the plurality of stabilizer blades when connected to the outer diameter of the pipe to immobilize each of the plurality of stabilizer blades when activated.

21 Claims, 5 Drawing Sheets

SHRINKABLE SLEEVE STABILIZER

BACKGROUND OF THE INVENTION

1. Field of the Invention

The present invention relates to stabilizers for pipe strings in wellbores, and, in particular, a casing stabilizer.

2. Description of the Related Art

In the drilling of wells, such as those for oil and gas, a string of tubular members is threaded together to form a drillstring having a drill bit mounted on the distal end. The drill bit is rotated either from the earth's surface by rotating the drillstring or by a downhole motor.

To enhance well drilling operations, numerous tool have been developed for mounting and use at sub-surface locations in the drillstring. One such tool is a stabilizer. Stabilizers include various forms of centralizers. A centralizer contacts the borehole wall and effectively serves as a radial bearing or lateral support for the drillstring in the borehole. By holding the drillstring against lateral forces or radial movement, the centralizer acts along the unsupported column length of the drillstring to prevent buckling. The centralizer also reduces the bending stresses induced by movement of the drillstring. With the development of casing drilling, where the casing is used as the drill string and remains downhole as the wellborn liner, it is important that the integrity of the casing be maintained.

In conventional drilling, centralizers and other forms of stabilizers are usually formed by a tubular member with a plurality of outwardly extending fixed blades having wall contacting surfaces of hardened material that bear against or contact the sides of the borehole. The outwardly extending blades are usually mounted vertically or in a helical arrangement.

There are generally two major categories of centralizer used with casing strings. The first includes centralizers having blades that are essentially permanently connected. These centralizers are subject to wear, and during refurbishment, often require the addition of hard-facing which can result in a heated effected zone which leads to stress crack propagation. The second includes centralizers that are connected to an outer surface of the casing string. The means for connecting the centralizers to the casing string vary widely. One type of connection means includes the use of threaded connections which are inserted into the casing string at regular intervals by threading to the casing pipe threads in a conventional manner. Centralizers that thread into the casing string are very expensive and are not convenient to use since they must be selected to fit exactly to the connection type being used.

Another means for connecting the centralizers include locking collars to secure the centralizer to the casing or other drillstring. A locking collar uses set screws that engage into the material of the pipe. Through the locking collar, the centralizer is prevented from moving axially and from relative rotation on the pipe. However, a centralizer including a locking collar with set screws is relatively weak and sometimes cannot withstand the harsh drilling environment. In addition, the set screws damage the casing pipe, reducing its strength.

Another means for connecting the centralizers include use of a crimping device whereby portions of a tubular part of the body of the centralizer are crimped at periodic intervals to cause an interference (press) fit. Most types of such centralizers, however, include a tubular body which slides over an outer diameter of the casing string, and thus, is generally slipped over an end of the string. Further, although effective, such crimp on centralizers are generally not available for oil casing greater than 13 ⅜ inches.

Recognized by the inventor is the need for an improved centralizer/stabilizer design that does not require a permanent connection and means for connecting the centralizer/stabilizer that does not require threaded connections or locking collars, that can be used on both large and small casing sizes, and that can be connected to the outer diameter of an existing casing string without a need to access an end of the casing string.

SUMMARY OF THE INVENTION

In view of the foregoing, various embodiments of the present invention advantageously provide an improved centralizer/stabilizer design and methods for connecting the centralizer/stabilizer that does not require a permanent connection, that does not require threaded connections or locking collars, that can be used on both large and small casing sizes, and that can be connected to the outer diameter of an existing casing string without a need to access an end of the casing string.

More specifically, various embodiments of the present invention provide a stabilizer apparatus formed around an outer diameter of a pipe. An example of such stabilizer apparatus includes a plurality of elongate stabilizer blades configured to connect around an outer diameter of the well casing to thereby enhanced position stability of the well casing when operably positioned within the well bore. According to a preferred configuration, there includes a sufficient number of stabilizer blades to provide a set of equally spaced blades encircling the outer diameter of the well casing. Each of the elongate stabilizer blades include a pipe-facing surface, a well-bore facing surface opposite the pipe-facing surface, a pair of side surfaces extending therebetween, and a pair of ends typically ramped to facilitate passage over discontinuities in the well bore. Each stabilizer blade can be formed of ultra-high-molecular-weight polyethylene, typically via injection molding, although other methodologies of forming the blades are within the scope of the present invention as are the use of other materials or material combinations.

The shrinkable sleeve stabilizer can also include a shrinkable sleeve sized to wrap around an outer surface of the each of the plurality of stabilizer blades when connected to the outer diameter of the pipe, the shrinkable sleeve forming a complete circuit around the outer diameter of a portion of the casing string. The shrinkable sleeve is configured to form-fit around and in direct contact with each pair of side surfaces, the proximal and distal ends, and the well-bore facing surface of the each of the plurality of stabilizer blades and around outer surface portions of the casing string between each adjacent one of the stabilizer blades to thereby immobilize each of the plurality of stabilizer blades when activated.

According to an exemplary configuration, the shrinkable sleeve comprises a heat-shrinkable epoxy sheet, and an ultraviolet (UV) light activated protective fiberglass sheet surrounding the heat-shrinkable e.g., epoxy, sheet. Beneficially, the heat-shrinkable epoxy sheet portion of the sleeve allows the user to encircle the blades when positioned along the outer diameter of the casing string and, upon activation, to shrink (compress) against the outer surfaces of the blades to provide the above described immobilization. Further, the UV light activated protective fiberglass sheet portion of the sleeve provides enhanced impact protection to thereby prevent excessive damage to the shrinkable epoxy sheet portion during deployment and positioning in the well bore.

Various embodiments of the present invention also include methods of forming a shrinkable sleeve stabilizer on a pipe. An example of such a method includes the steps of providing a plurality of elongate stabilizer blades, and connecting each of the plurality of stabilizer blades around an outer diameter of a pipe (e.g., well casing, drilling pipe, etc.) in a spaced apart relationship to enhance position stability of the pipe when operably positioned within a well bore. The method can also include wrapping a shrinkable sleeve around an outer surface of the each of the plurality of stabilizer blades connected to the outer diameter of the pipe and the outer surface of the pipe between the stabilizer blades to form a circuit around the outer diameter of the portion of the pipe carrying the plurality of stabilizer blades.

The method further includes activating the shrinkable sleeve to cause the sleeve to shrink around the outer surfaces of the plurality of stabilizer blades and around outer surface portions of the outer diameter of the pipe. Advantageously, when activated, the shrinkable sleeve form-fits around and in direct contact with each pair of side surfaces, the proximal and distal ends, and the well-bore facing surface of the each of the plurality of stabilizer blades and around outer surface portions of the pipe between each adjacent one of the plurality of stabilizer blades to thereby immobilize each of the plurality of stabilizer blades. According to an exemplary configuration, the step of activating includes applying heat to the heat-shrinkable epoxy sheet, and applying ultraviolet light to the protective fiberglass sheet to cure the protective fiberglass sheet.

BRIEF DESCRIPTION OF THE DRAWINGS

So that the manner in which the features and advantages of the invention, as well as others which will become apparent, may be understood in more detail, a more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

The present invention will now be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout. Prime notation, if used, indicates similar elements in alternative embodiments.

FIGS. 1-8 illustrate for an improved stabilizer design and methods of forming such a stabilizer that does not require a permanent connection and means for connecting the centralizer/stabilizer that does not require threaded connections or locking collars, can be used on both large and small pipe sizes, and that can be connected to the outer diameter of an existing pipe string without a need to access an end of the pipe string.

Figure 1:
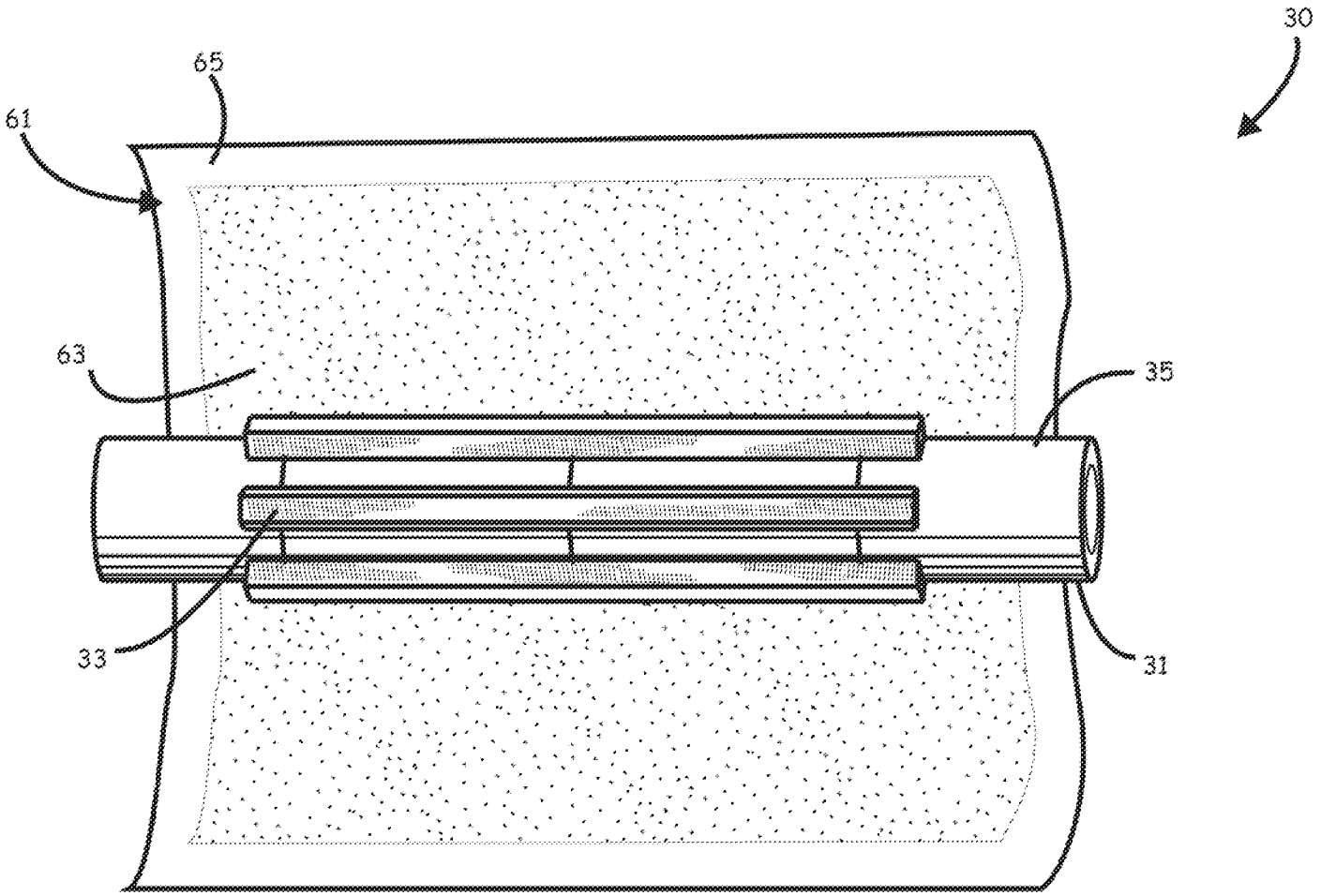
FIG. 1 is a perspective view of a shrinkable sleeve stabilizer being formed around a portion of a pipe according to an embodiment of the present invention.
Figure 2:
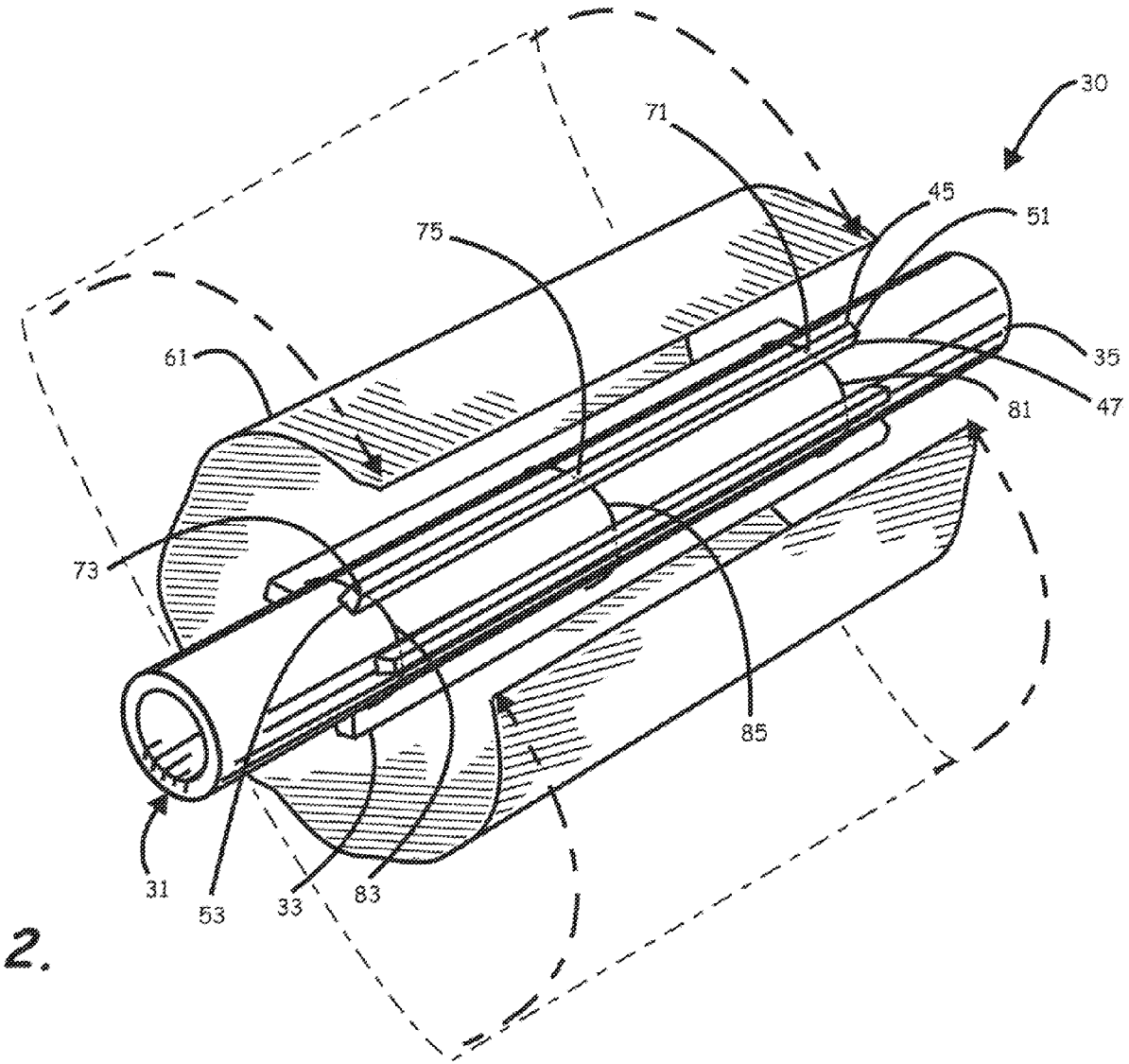
FIG. 2 is a perspective view of a shrinkable sleeve stabilizer being formed around a portion of a pipe according to an embodiment of the present invention.
Figures 3, 4:
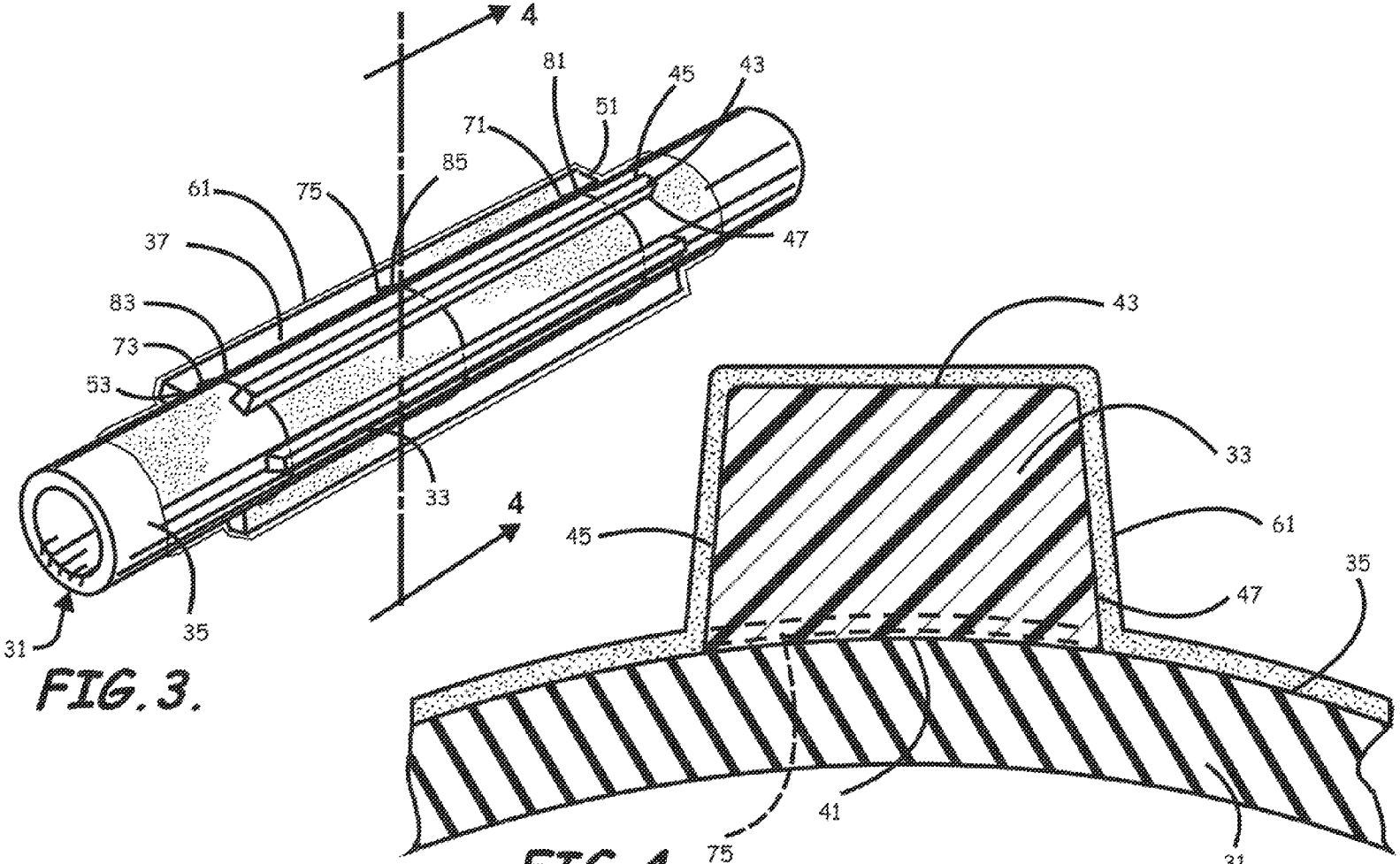
FIG. 3 is a perspective view of a shrinkable sleeve stabilizer formed around a portion of a pipe according to an embodiment of the present invention.
FIG. 4 is a schematic diagram of a stabilizer blade taken along the 4-4 line of FIG. 3 according to an embodiment of the present invention.

Specifically, FIGS. 1-3 illustrate an example of a stabilizer apparatus, e.g., shrinkable sleeve stabilizer 30 formed/being formed around an outer diameter of a pipe such as, for example, a well casing 31, for providing a radial bearing or lateral support to enhance stabilization of the well casing 31 in the well bore (not shown). According to the illustrated configuration, the shrinkable sleeve stabilizer 30 can include a plurality of elongate stabilizer blades 33 configured to connect around an outer diameter (surface) 35 of the well casing 31 to thereby enhanced position stability of the well casing 31 when operably positioned within the well bore. According to a preferred configuration, depending upon the size of the outer circumference of the outer surface 35 of well casing 31 and the width of the each of the stabilizer blades 33, stabilizer 30 is equipped with a sufficient number of stabilizer blades 33 to provide a set of equally spaced blades 33 encircling the outer diameter 35 of the well casing 31.

As perhaps best shown in FIG. 4, each of the elongate stabilizer blades 33 include a pipe (casing string)-facing surface 41, a well-bore facing surface 43 opposite the pipe-facing surface 41, a pair of side surfaces 45, 47, extending therebetween, and a pair of ends 51, 53 (see e.g., FIG. 2). According to the illustrated configuration, side surfaces 45, 47 are oriented at an acute angle so that the profile of the blades 33 form a trapezoidal shape. Alternatively, side surfaces 45, 47 can be substantially parallel. Further, according to the illustrated configuration, ends 51, 53 can be ramped to facilitate passage over discontinuities in the well bore. Various other configurations are, however, within the scope of the present invention.

According to an example of embodiments of the stabilizer 30, each stabilizer blade 33 can be formed of ultra-high-molecular-weight polyethylene, although other material compositions are within the scope of the present invention. Blades 33 can be manufactured according to various methodologies known to those of ordinary skill in the art, typically via injection molding, although other methodologies of forming the blades 33 are within the scope of the present invention.

Primarily referring to FIGS. 3 and 4, according to the illustrated configuration, the shrinkable sleeve stabilizer 30 can also include a shrinkable sleeve 61 sized to wrap around the outer surface (e.g., surfaces 43, 45, 47) of the each of the of stabilizer blades 33 when connected to the outer diameter 35 of the well casing 31 such that the shrinkable sleeve 61 forms a complete circuit around the outer diameter 35 of a portion of the well casing 31. That is, as perhaps best shown in FIG. 4, the shrinkable sleeve 61 is configured to form-fit around and in direct contact with the well-bore facing surface 43, each pair of side surfaces 45, 47, and the proximal and distal ends 51, 53 (see, e.g., FIG. 3) of the each of the plurality of stabilizer blades 33 and around portions of the outer surface 35 of the well casing 31 between each adjacent one of the stabilizer blades 33 to thereby immobilize each of the plurality of stabilizer blades 33 when e.g., heat activated.

Referring primarily to FIG. 1, according to a preferred configuration, the shrinkable sleeve 61 comprises a heat-shrinkable, e.g., epoxy, sheet 63, and an ultraviolet (UV) light activated protective fiberglass sheet 65 surrounding the heat-shrinkable epoxy sheet 63. Beneficially, the heat-shrinkable epoxy sheet portion 63 of the sleeve 61 allows the user to encircle the blades 33 when positioned along the outer diameter 35 of the well casing 31 and, upon activation, to shrink (compress) against the outer surfaces 41, 43, 45 of the blades 33 to provide the above described immobilization. Further, the UV light activated protective fiberglass sheet portion 65 of the sleeve 61 provides enhanced impact protection to thereby prevent excessive damage to the shrinkable epoxy sheet portion 63 during deployment and positioning in the well bore.

Referring to FIGS. 2-4, according to a first configuration, each of the stabilizer blades 33 includes multiple wire receiving apertures 71, 73, 75, to provide a means for temporarily immobilizing the blades 33 prior to encirclement by the shrinkable sleeve. That is, according to the exemplary embodiment of the stabilizer 30, each of the stabilizer blades 33 includes a first wire receiving aperture 71 extending through a lateral portion of the blade 33 adjacent a proximal end portion 51, a second wire receiving aperture 73 extending through at least one lateral portion of the respective stabilizer blade 33 adjacent a distal end portion 53, and at least one, but more typically a plurality of wire receiving apertures 75 extending through a medial portion of the respective stabilizer blade 33.

Referring to FIGS. 2 and 3, when operationally configured, a first section 81 of wire extends through each of the proximally located wire receiving apertures 71, a second section 83 of wire extends through each of the distally located wire receiving apertures 73, and one or more additional sections of wire 85 extend through a corresponding medially located adjacent wire receiving apertures 75. As perhaps best illustrated in FIG. 2, the wire configuration can be provided so that when the stabilizer blades 33 are operably positioned around the outer diameter of the well casing 31, the first section of wire 81 extends around the outer diameter of the proximal end portion 51, the second section of wire 83 extends around the outer diameter of a portion of the well casing 31 adjacent a distal end portion 53, and the additional sections of wire 85 extend around the outer diameter of the respective medial portions of the well casing 31 so as to semi-primarily connect the stabilizer blades 33 to the outer diameter 35 of the well casing 31. To this end, the stabilizer blades 33 are positioned around the well casing 31 so that the wire receiving apertures 71, 73, 75, are at least substantially radially aligned with corresponding wire receiving apertures 71, 73, 75, respectively, in each other of the stabilizer blades 33.

Figure 6:
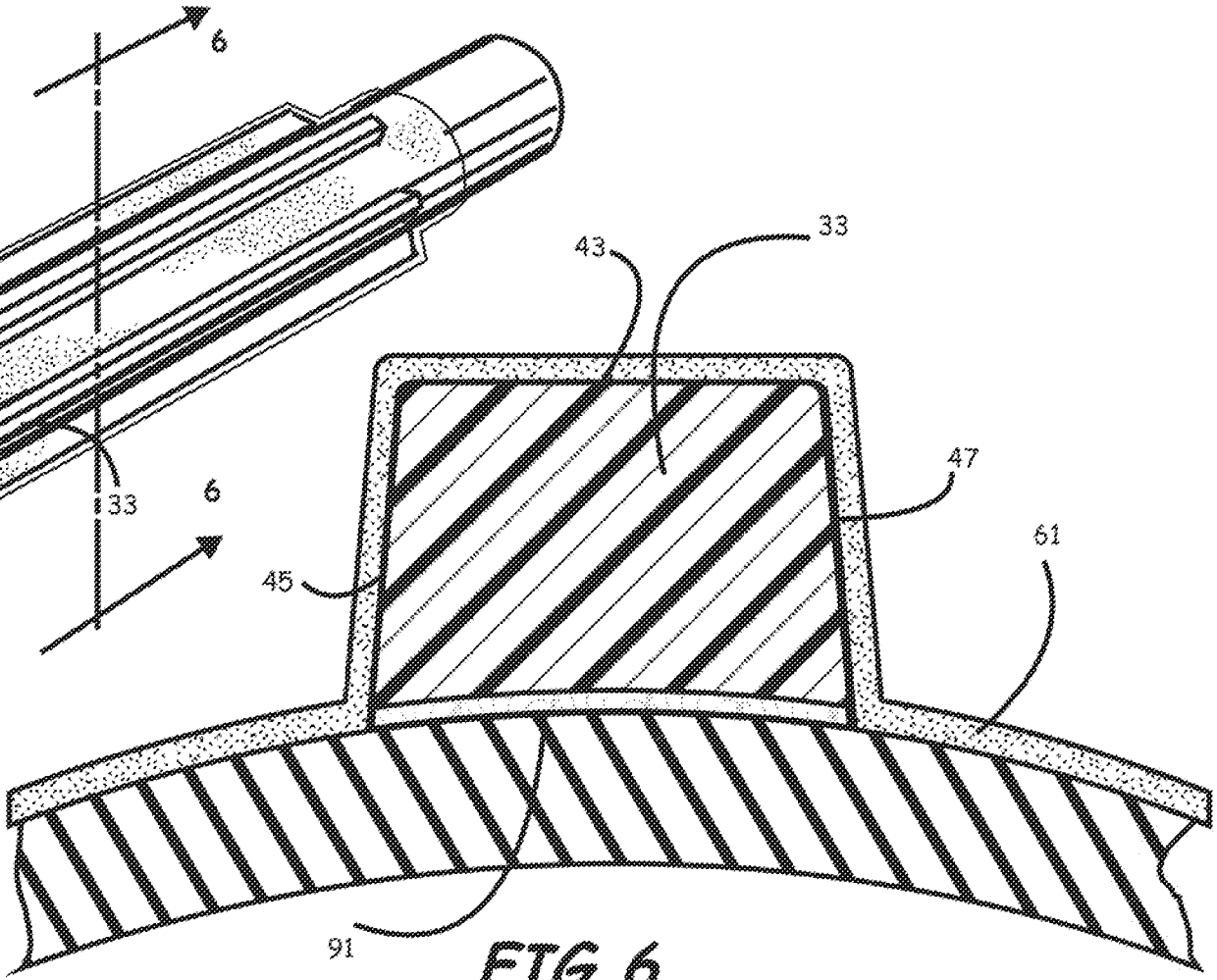
FIG. 6 is a schematic diagram of a stabilizer blade taken along the 6-6 line of FIG. 5 according to an embodiment of the present invention.
Figure 5:
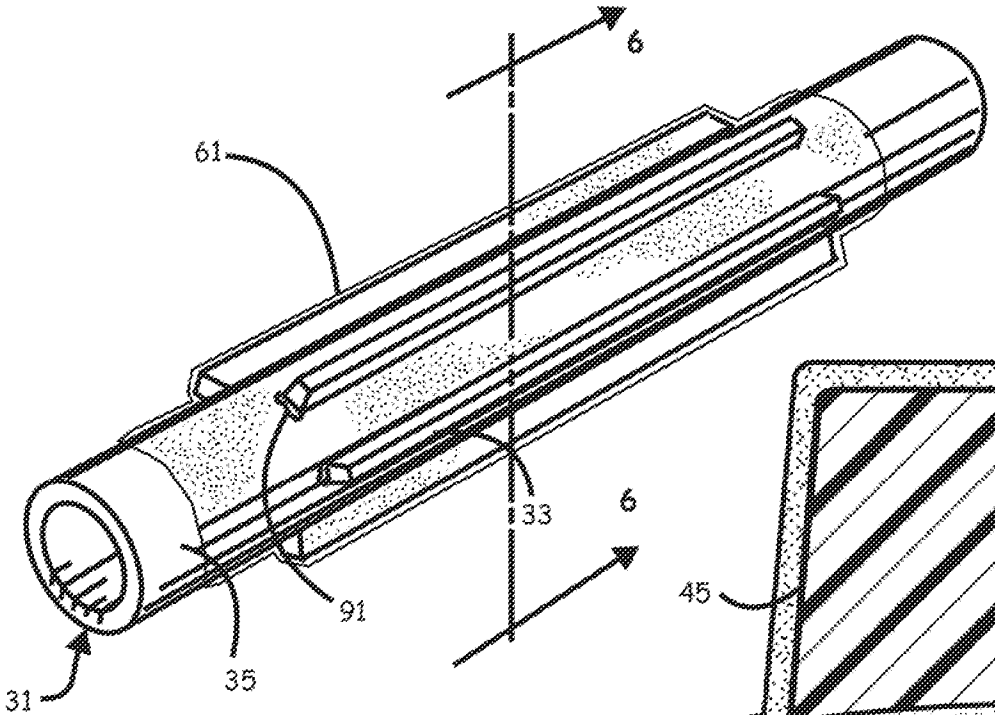
FIG. 5 is a perspective view of a shrinkable sleeve stabilizer formed around a portion of a pipe according to an embodiment of the present invention.
Figure 7:
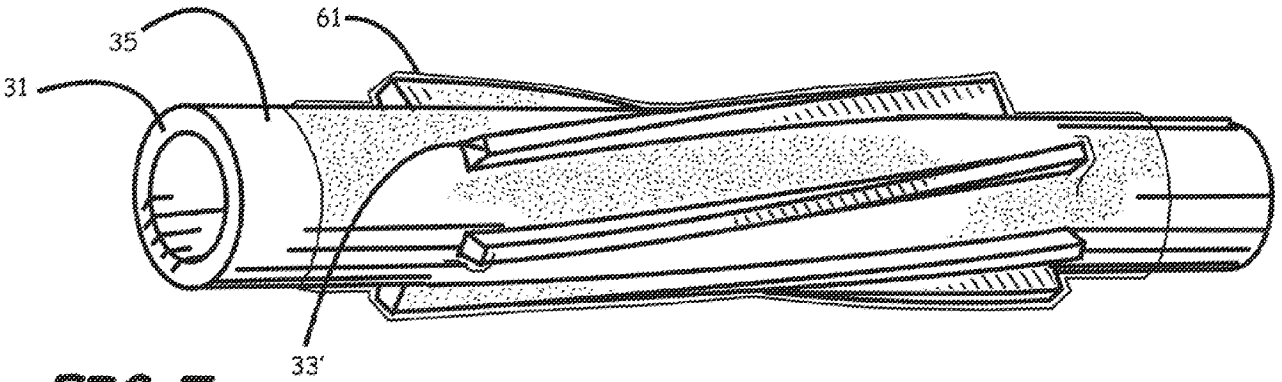
FIG. 7 is a perspective view of a shrinkable sleeve stabilizer formed around a portion of a pipe according to an embodiment of the present invention.

Referring to FIGS. 5 and 6, according to an alternative embodiment of the stabilizer blades 33, each blade 33 includes a low-shear resistance removable pressure sensitive adhesive 91. According to one configuration, the adhesive can be pre-positioned on a pipe-facing surface 41 of the respective stabilizer blade 33. A protective laminate cover (not shown) can be positioned atop the adhesive until the operator is ready to adhere the respective stabilizer blade 33 to the outer surface of the well casing 31. According to another configuration, the adhesive 91 is applied prior to positioning the stabilizer blade 33 on the desired portion of the outer surface 35 of the well casing 31. In both configurations, the low-shear resistance adhesive 91 is typically utilized to prevent inadvertent fowling of the outer surface 35 of the well casing 31 during removal of the blades 33 and/or adhesive 91. Other forms of adhesive are, however, within the scope of the present invention. Further, other means for temporarily setting the position of the stabilizer blades 33 prior to and/or during application and activation/curing of the shrinkable sleeve 61 are also within the scope of the present invention.

Note, although the stabilizer blades 33 are shown in FIGS. 1-6 as being oriented at least substantially parallel with the longitudinal axis of the well casing 31, other configurations are, however, within the scope of the present invention. For example, as perhaps best shown in FIG. 7, each of the plurality of elongate stabilizer blades 33' can include a twist so as to form a helical configuration when positioned along the outer surface and along the outer diameter of the well casing 31.

Figure 8:
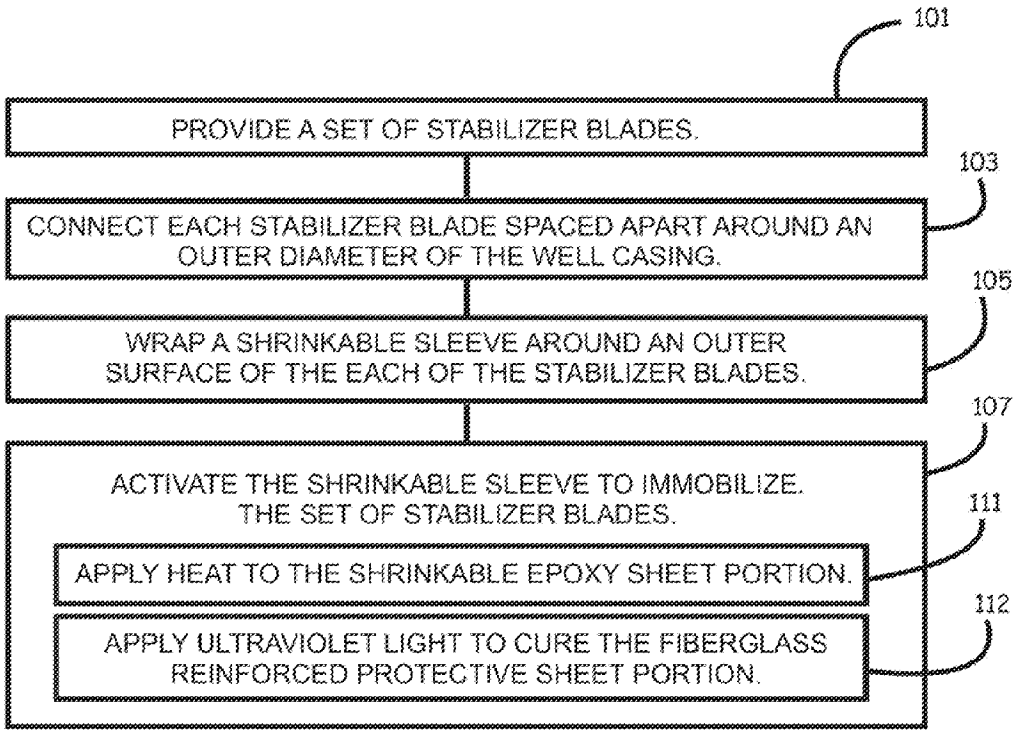
FIG. 8 is a schematic flow diagram illustrating steps for forming a shrinkable sleeve stabilizer being around a portion of a pipe according to an embodiment of the present invention.

Embodiments of the present invention include methods of forming or otherwise connecting a centralizer or other form of stabilizer such as, for example, shrinkable sleeve stabilizer 30 to the outer surface of a pipe. Particularly, FIG. 8 provides a high-level flow diagram illustrating a method for forming or otherwise connecting a shrinkable sleeve stabilizer 30 to the outer surface of the well casing 31 to enhance position stability of the well casing 31 when operably positioned within a well bore. The method can include first providing a set of a plurality of typically elongate stabilizer blades 33 (block 101). The blades 33 can be formed of various materials known to those of ordinary skill in the art, although ultra-high-molecular-weight polyethylene provides substantial benefits over others. Various methodologies of forming blades 33 can be used. An example of one such methodology includes injection molding. Others, however, are within the scope of the present invention.

Referring also to FIG. 1, the method can include connecting each of the plurality of stabilizer blades 33 spaced-apart around an outer diameter of the well casing 31 (block 103). FIGS. 2 and 3 illustrate an example methodology which employs wires 81, 83, 85 to temporarily holds blades 33 in place for further processing. According to this embodiment, the step of connecting each of the stabilizer blades 33 can include positioning the stabilizer blades 33 around the outer diameter of the well casing 31 and extending a first section of wire 81 through a first set of adjacent wire receiving apertures 71, extending a second section of wire 83 through a second set of adjacent wire receiving apertures 73, and extending a third section of wire 85 through a third set of adjacent wire receiving apertures 75 extending through each stabilizer blade 33, to semi-permanently connect the stabilizer blades 33 to the outer diameter 35 of the well casing 31.

FIG. 6 illustrates another example methodology which employs low-shear resistance removable pressure sensitive adhesive 91 applied or pre-formed to the pipe-facing surface of the blades 33. According to this methodology, the step of connecting each of the stabilizer blades 33 comprises applying a low-shear resistance removable pressure sensitive adhesive 91 to a pipe-facing surface 41 of each of the stabilizer blades 33 (or alternatively, directly to the outer surface 35 of the well casing 31), and positioning the blades 33 around the outer diameter 35 of the well casing 31. If adhesive 91 is pre-covered with a protective backing, this methodology would, of course, include removal prior to attachment to the outer surface 35.

Referring also to FIG. 2, the method can include wrapping a shrinkable sleeve 61 around an outer surface 43, 45, 47 of the each stabilizer blade 33 connected to the outer diameter 35 of the well casing 31 (block 105). According to the exemplary configuration, the shrinkable sleeve 61 forms a complete circuit around the outer diameter 35 of the portion of the well casing 31 carrying the stabilizer blades 33 to immobilize the blades 33, providing the benefits of a normal crimp-on stabilizer without the need for any large tools.

As illustrated in FIG. 2, the shrinkable sleeve 61 can include a heat-shrinkable epoxy sheet portion 63, which can function to enhance immobilization of the blades 33, and can include an ultraviolet (UV) light activated protective fiberglass sheet portion 65 surrounding the heat-shrinkable epoxy sheet portion 63, which can function to reduce potential damage to the shrinkable sheet portion 63, particularly during deployment of the well casing 31.

Referring also to FIGS. 3 and 4, the method can include activating the shrinkable sleeve 61 to cause the sleeve 61 to shrink around the outer surfaces 43, 45, 47 of the stabilizer blades 33 and around outer surface portions of the outer diameter 35 of the well casing 31 (block 107), whereby the combination of stabilizer blades 33 and shrinkable sleeve 61 forms the shrinkable sleeve stabilizer 30. Beneficially, according to the exemplary embodiment, when activated, the shrinkable sleeve 61 form-fits around and in direct contact with each pair of side surfaces 45, 47, the proximal and distal ends 51, 53 (see, e.g., FIG. 2), and the well-bore facing surface 43 of the each of the stabilizer blades 33 and around outer surface portions of the well casing 31 between each adjacent stabilizer blade 33 to thereby immobilize each of the plurality of stabilizer blades 33.

According to a preferred implementation, the step of activating the shrinkable sleeve 61 includes applying heat to the heat-shrinkable epoxy sheet 63 to cause the sheet to tighten and form-fit around and between the set of stabilizer blades 33 (block 111). The step of activating the shrinkable sleeve 61 also includes applying ultraviolet light to the protective fiberglass sheet 65 to cure the protective fiberglass sheet 65, thereby forming a protective overcoat (block 113).

Embodiments of the present invention have several advantages. For example, embodiments of the sleeve system 30 can be easily field installed on existing pipe at the rigsite or in a pipe yard. Further advantageously, as the components of the sleeve system 30 can be built around the outer surface of existing pipe, catastrophic failure to any of the various components would result in little or no consequences to drilling/running operations. Advantageously, various embodiments of the sleeve system 30 do not require any large tools. Still further, various embodiments of the sleeve system 30 advantageously operationally provide the functionality of a crimp-on stabilizer.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification. For example, although fiberglass reinforced sheet 65 was described as surrounding the heat-shrinkable epoxy sheet 63, heat-shrinkable epoxy sheet 63 can instead surround portions of fiberglass sheet 65. Further, although examples or primarily directed to a pipe in the form of a well casing, other application to other forms of pipe or within the scope of the present invention.

That claimed is:

1. A method of forming a stabilizer on a pipe, the method comprising the steps of:

forming a plurality of elongate stabilizer blades, each of the plurality of stabilizer blades including a plurality of wire receiving apertures, a first wire receiving aperture of the plurality of apertures extending through at least one lateral portion of the respective stabilizer blade adjacent a proximal end portion, a second wire receiving aperture of the plurality of apertures extending through at least one lateral portion of the respective stabilizer blade adjacent a distal end portion;

connecting each of the plurality of stabilizer blades spaced apart around an outer diameter of the pipe, so that each separate one of the plurality of wire receiving apertures in each of the stabilizer blades are substantially radially aligned with a corresponding separate one of the plurality of wire receiving apertures in each of the plurality of stabilizer blades to thereby form a corresponding at least two sets of adjacent wire receiving apertures, to include:

positioning the plurality of stabilizer blades around the outer diameter of the pipe, extending a first section of wire through a first set of adjacent wire receiving apertures, and extending a second section of wire through a second set of adjacent wire receiving apertures, the first section of wire at least substantially extending around the outer diameter of a portion of the pipe adjacent a proximal end thereof, the second section of wire at least substantially extending around the outer diameter of a portion of the pipe adjacent a distal thereof, the wires semi-permanently connecting the plurality of stabilizer blades to the outer diameter of the pipe, to enhance position stability of the pipe when operably positioned within a well bore;

wrapping a shrinkable sleeve around an outer surface of each of the plurality of stabilizer blades connected to the outer diameter of the pipe, the shrinkable sleeve forming a circuit around the outer diameter of a portion of the pipe carrying the plurality of stabilizer blades; and activating the shrinkable sleeve to cause the sleeve to shrink around the outer surfaces of the plurality of stabilizer blades and around an outer surface portions of the outer diameter of the pipe to thereby immobilize each of the plurality of stabilizer blades, the combination of stabilizer blades and shrinkable sleeve forming a shrinkable sleeve stabilizer.

2. A method as defined in claim 1, wherein each of the elongate stabilizer blades comprises the proximal end, the distal end, and a medial portion, the medial portion comprising a pipe-facing surface, a well-bore facing surface opposite the pipe-facing surface, and a pair of side surfaces extending therebetween; and wherein when activated, the shrinkable sleeve form-fits around and in direct contact with each pair of side surfaces and the well-bore facing surface of each of the plurality of stabilizer blades.

3. A method as defined in claim 2, wherein the shrinkable sleeve is a heat-shrinkable sleeve, and wherein, when activated, the heat-shrinkable sleeve further form-fits around and in direct contact with the proximal end and the distal end of each of the plurality of stabilizer blades and around outer surface portions of the pipe between each adjacent one of the plurality of stabilizer blades.

4. A method as defined in claim 2, wherein the shrinkable sleeve comprises a heat-shrinkable epoxy sheet; and wherein the step of activating the shrinkable sleeve comprises applying heat to the heat-shrinkable epoxy sheet.

5. A method as defined in claim 2, wherein the shrinkable sleeve further comprises a protective fiberglass sheet surrounding a heat-shrinkable epoxy sheet when operably positioned around the plurality of stabilizer blades; and wherein the step of activating the shrinkable sleeve comprises applying ultraviolet light to the protective fiberglass sheet to cure the protective fiberglass sheet.

6. A method a defined in claim 1, wherein the plurality of wire receiving apertures further includes a third wire receiving aperture extending through a medial portion of the respective stabilizer blade.

7. A method as defined in claim 1, wherein the step of connecting each of the plurality of stabilizer blades comprises applying a low-shear resistance removable pressure sensitive adhesive to a pipe-facing surface of each of the stabilizer blades, and positioning the plurality of stabilizer blades around the outer diameter of the pipe.

8. A method as defined in claim 1, wherein the pipe comprises well easing; and wherein each of the stabilizer blades comprise ultra-high-molecular-weight polyethylene.

9. A method of forming a stabilizer on a pipe comprising a well casing, the method comprising the steps of:

providing a plurality of elongate stabilizer blades, each of the elongate stabilizer blades comprising a proximal end, a distal end, and a medial portion, the medial portion comprising a pipe-facing surface, a well-bore facing surface opposite the pipe-facing surface, and a pair of side surfaces extending therebetween, each of the plurality of stabilizer blades including a plurality of wire receiving apertures, a first wire receiving aperture of the plurality of apertures extending through at least one lateral portion of the respective stabilizer blade adjacent a proximal end portion, a second wire receiving aperture of the plurality of apertures extending through at least one lateral portion of the respective stabilizer blade adjacent a distal end portion, and a third wire receiving aperture extending through a medial portion of the respective stabilizer blade;

connecting each of the plurality of stabilizer blades spaced apart around an outer diameter of the pipe to enhance position stability of the pipe when operably positioned within a well bore, to include:

positioning the plurality of stabilizer blades around the outer diameter of the pipe, extending a first section of wire through a first set of adjacent wire receiving apertures, extending a second section of wire through a second set of adjacent wire receiving apertures, and extending a third section of wire through a third set of adjacent wire receiving apertures, the first section of wire at least substantially extending around the outer diameter of a portion of the pipe adjacent proximal end thereof, the second section of wire at least substantially extending around the outer diameter of a portion of the pipe adjacent a distal end thereof, the third section of wire at least substantially extending around the outer diameter of a portion of the pipe adjacent a medial portion thereof, the wires semi-permanently connecting the plurality of stabilizer blades to the outer diameter of the pipe; and wrapping a shrinkable sleeve around an outer surface of each of the plurality of stabilizer blades connected to the outer diameter of the pipe, the shrinkable sleeve forming a circuit around the outer diameter of a portion of the pipe carrying the plurality of stabilizer blades; and activating the shrinkable sleeve to cause the sleeve to shrink around the outer surfaces of the plurality of stabilizer blades and around an outer surface portions of the outer diameter of the pipe so that when activated, the shrinkable sleeve form-fits around and in direct contact with each pair of side surfaces, the proximal and distal ends, and the well-bore facing surface of each of the plurality of stabilizer blades and around outer surface portions of the pipe between each adjacent one of the plurality of stabilizer blades to thereby immobilize each of the plurality of stabilizer blades, the combination of stabilizer blades and shrinkable sleeve forming a shrinkable sleeve stabilizer.

10. A method as defined in claim 9, wherein the shrinkable sleeve comprises:

a heat shrinkable epoxy sheet, and an ultraviolet (UV) light activated protective fiberglass sheet surrounding the heat-shrinkable epoxy sheet when operably positioned around the plurality of stabilizer blades; and wherein the step of activating the shrinkable sleeve comprises:

applying heat to the heat-shrinkable epoxy sheet, and applying ultraviolet light to the protective fiberglass sheet to cure the protective fiberglass sheet.

11. A stabilizer apparatus formed around an outer diameter of a pipe, the apparatus comprising:

a plurality of elongate stabilizer blades configured to connect around an outer diameter of the pipe to thereby enhance position stability of the pipe when operably positioned within a well bore, each of the plurality of stabilizer blades including a plurality of wire receiving apertures, each separate one of the plurality of wire receiving aperture in each of the stabilizer blades being substantially radially aligned with a corresponding separate one of the plurality of wire receiving apertures in each other of the plurality of stabilizer blades when the stabilizer blades are operably positioned around the outer diameter of the pipe to thereby form a corresponding at least two sets of adjacent wire receiving apertures, a first section of wire extending through a second set of adjacent wire receiving apertures, the first section of wire at least substantially extending around the outer diameter of a portion of the pipe adjacent a proximal end thereof, the second section of wire at least substantially extending around the outer diameter of a portion of the pipe adjacent a distal end thereof, the wires semi-permanently connecting the plurality of stabilizer blades to the outer diameter of the pipe; and a shrinkable sleeve sized to wrap around an outer surface of each of the plurality of stabilizer blades when connected to the outer diameter of the pipe, the shrinkable sleeve forming a circuit around the outer diameter of a portion of the pipe carrying the plurality of stabilizer blades to thereby immobilize each of the plurality of stabilizer blades when activated.

12. An apparatus as defined in claim 11, wherein each of the elongate stabilizer blades comprises a proximal end, a distal end, and a medial portion, the medial portion comprising a pipe-facing surface, a well-bore facing surface opposite the pipe-facing surface, and a pair of side surfaces extending therebetween; and wherein when activated, the shrinkable sleeve form-fits around and in direct contact with each pair of side surfaces and the well-bore facing surface of each of the plurality of stabilizer blades.

13. An apparatus as defined in claim 12, wherein the shrinkable sleeve is a heat-shrinkable sleeve, and wherein, when activated, the heat-shrinkable sleeve further form-fits around and in direct contact with the proximal end and the distal end of each of the plurality of stabilizer blades and around outer surface portions of the pipe between each adjacent one of the plurality of stabilizer blades.

14. An apparatus as defined in claim 12, wherein the shrinkable sleeve is a heat-shrinkable epoxy sheet.

15. An apparatus as defined in claim 12, wherein the shrinkable sleeve further comprises an ultraviolet (UV) light activated protective fiberglass sheet surrounding a heat-shrinkable epoxy sheet when operably positioned around the plurality of stabilizer blades.

16. An apparatus as defined in claim 11, wherein each of the plurality of wire receiving apertures, includes a first wire receiving aperture of the plurality of apertures extending through at least one lateral portion of the respective stabilizer blade adjacent a portion of the proximal end, a second wire receiving aperture of the plurality of apertures extending through at least one lateral portion of the respective stabilizer blade adjacent a portion of the distal end.

17. An apparatus as defined in claim 16, wherein the plurality of wire receiving apertures further includes a third wire receiving aperture extending through a medial portion of the respective stabilizer blade.

18. An apparatus as defined in claim 11, each of the plurality of stabilizer blades comprises a low-shear resistance removable pressure sensitive adhesive positioned on a pipe-facing surface of the blade.

19. An apparatus as defined in claim 11, wherein the pipe comprises well casing; and wherein each of the stabilizer blades comprise ultra-high-molecular-weight polyethylene.

20. A stabilizer apparatus formed around an outer diameter of a pipe, the apparatus comprising:

a plurality of elongate stabilizer blades configured to connect around an outer diameter of the pipe to thereby enhance position stability of the pipe when operably positioned within a well bore, each of the elongate stabilizer blades comprising as proximal end, a distal end, a medial portion comprising a pipe-facing surface, a well-bore facing surface opposite the pipe-facing surface, and a pair of side surfaces extending therebetween, and a plurality of wire receiving apertures, a first wire receiving aperture of the plurality of apertures extending through at least one lateral portion of the respective stabilizer blade adjacent a proximal end portion, a second wire receiving aperture of the plurality of apertures extending through at least one lateral portion of the respective stabilizer blade adjacent a distal end portion, and a third wire receiving aperture extending through a medial portion of the respective stabilizer blade, each separate one of the plurality of wire receiving apertures in each of the stabilizer blades being substantially radially aligned with a corresponding separate one of the plurality of wire receiving apertures in each other of the plurality of stabilizer blades when the stabilizer blades are operably positioned around the outer diameter of the pipe to thereby form a corresponding at least three sets of adjacent wire receiving apertures;

a first section of wire extending through a first set of adjacent wire receiving apertures, a second section of wore extending through a second set of adjacent wire receiving apertures, and a third section of wire extending through a third set of adjacent wire receiving apertures, when the stabilizer blades are operably positioned around the outer diameter of the pipe, the first section of wire at least substantially extending around the outer diameter of a portion of the pipe adjacent a proximal end thereof, the second section of wire at least substantially extending around the outer diameter of a portion of the pipe adjacent a dismal end thereof, the third section of wire at least substantially extending around the outer diameter of a portion of the pipe adjacent a medial portion thereof, the wires semi-permanently connecting the plurality of stabilizer blades to the outer diameter of the pipe; and a shrinkable sleeve sized to wrap around an outer surface of each of the plurality of stabilizer blades when connected to the outer diameter of the pipe, the shrinkable sleeve forming a circuit around the outer diameter of a portion of the pipe carrying the plurality of stabilizer blades to thereby immobilize each of the plurality of stabilizer blades, the shrinkable sleeve configured to form-fit around and in direct contact with each pair of side surfaces, the proximal and distal ends, and the well-bore facing surface of each of the plurality of stabilizer blades and around outer surface portions of the pipe between each adjacent one of the plurality of stabilizer blades to thereby immobilize each of the plurality of stabilizer blades when activated.

21. An apparatus as defined in claim 20, wherein each of the stabilizer blades comprise ultra-high-molecular-weight polyethylene; and wherein the shrinkable sleeve comprises:

a heat-shrinkable epoxy sheet, and an ultraviolet (UV) light activated protective fiberglass sheet surrounding the heat-shrinkable epoxy sheet when operably positioned around the plurality of stabilizer blades.

* * * * *